US011530791B2

(12) United States Patent
Aubert et al.

(10) Patent No.: US 11,530,791 B2
(45) Date of Patent: Dec. 20, 2022

(54) MOTOR VEHICLE LIGHT MODULE COMPRISING A PLURALITY OF LIGHT GUIDES

(71) Applicant: VALEO VISION, Bobigny (FR)

(72) Inventors: Julien Aubert, Bobigny (FR); Hugo Mestre, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/269,431

(22) PCT Filed: Aug. 6, 2019

(86) PCT No.: PCT/EP2019/071122

§ 371 (c)(1),
(2) Date: Feb. 18, 2021

(87) PCT Pub. No.: WO2020/043443

PCT Pub. Date: Mar. 5, 2020

(65) Prior Publication Data

US 2021/0180760 A1 Jun. 17, 2021

(30) Foreign Application Priority Data

Aug. 31, 2018 (FR) ..... 18 57863

(51) Int. Cl.
*F21V 13/00* (2006.01)
*F21S 41/24* (2018.01)
(Continued)

(52) U.S. Cl.
CPC ..... *F21S 41/24* (2018.01); *F21S 41/147* (2018.01); *F21S 41/151* (2018.01); *F21S 41/25* (2018.01);
(Continued)

(58) Field of Classification Search
CPC ..... F21S 41/24; F21S 41/143; F21S 41/147; F21S 41/151; F21S 41/25; F21S 41/663;
(Continued)

(56) References Cited

U.S. PATENT DOCUMENTS

2006/0087861 A1 4/2006 Tessnow et al.
2014/0133168 A1* 5/2014 Fiederling ..... F21S 41/24 362/235

(Continued)

FOREIGN PATENT DOCUMENTS

CN 1742217 A * 3/2006 ..... B60Q 1/0011
KR 20090028434 A * 3/2009
WO WO 2017/106891 A1 6/2017

OTHER PUBLICATIONS

International Search Report dated Nov. 29, 2019 in PCT/EP2019/071122 filed Aug. 6, 2019, citing documents AA-AC and AO therein, 2 pages.

(Continued)

*Primary Examiner* — Omar Rojas Cadima
(74) *Attorney, Agent, or Firm* — Oblon, McClelland, Maier & Neustadt, L.L.P.

(57) ABSTRACT

The invention relates to a motor vehicle light module comprising: —a part comprising a plurality of light guides, each of said light guides extending between an input diopter of the same guide and an output, the adjacent light guides joining to one another by a material junction; —several light sources arranged opposite the input diopters of all or a portion of the light guides; and—a projection system downstream from the guide outputs that has a focal surface (F) projecting an image of any light ray passing through the focal surface. According to the invention, the light module comprises at least two guides of which the distance (d1) between the focal surface (F) and the junction of said two (Continued)

guides is greater than the distance (d2) between the focal surface (F) and the junction of the other guides.

20 Claims, 4 Drawing Sheets

(51) Int. Cl.

| | |
|---|---|
| ***F21S 41/25*** | (2018.01) |
| ***F21S 41/663*** | (2018.01) |
| ***F21S 41/147*** | (2018.01) |
| ***F21S 41/151*** | (2018.01) |
| *F21Y 115/10* | (2016.01) |

(52) U.S. Cl.
CPC ..... *F21S 41/663* (2018.01); *F21Y 2115/10* (2016.08)

(58) Field of Classification Search
CPC ..... F21S 41/27; F21S 41/285; F21S 41/00; F21S 41/153; F21W 2102/145; F21W 2102/00; F21W 2102/13; F21W 2102/155; F21Y 2115/10; G02B 6/00
See application file for complete search history.

(56) References Cited

U.S. PATENT DOCUMENTS

| | | | | |
|---|---|---|---|---|
| 2015/0226395 | A1 | 8/2015 | Taudt et al. | |
| 2017/0089536 | A1* | 3/2017 | Courcier ..... | F21S 41/24 |
| 2018/0328562 | A1 | 11/2018 | Taudt et al. | |

OTHER PUBLICATIONS

European Office Action dated Jul. 5, 2022 in European Application No. 19 753 006.6, 5 pgs.

* cited by examiner

MOTOR VEHICLE LIGHT MODULE COMPRISING A PLURALITY OF LIGHT GUIDES

The invention relates to a motor vehicle light module. In particular, the invention relates to a light module comprising a plurality of light guides and capable of generating a pixelated light beam.

It is known that there are light modules capable of generating a pixelated beam, the projection of which forms an image composed of lighting units, also called "pixels". Said units are organized into at least one horizontal and/or vertical array, and each of the lighting units may be activated selectively.

Such a light module is used together with a second light module capable of generating a main lighting and signaling beam for forming a lighting and signaling beam incorporating one or more adaptive functions.

By way of example, the pixelated beam is illuminated with a portion of high beam, to provide an adaptive road function known as ADB, for "Adaptive Driving Beam". This function enables a beam to be formed with a shadow area arranged at the level of an oncoming vehicle and/or at the level of a vehicle ahead. The aim of this function is to provide better visibility for the driver of the vehicle, while avoiding dazzling the driver of the oncoming vehicle and/or the vehicle ahead.

In some applications, the light beam must comprise an area requiring powerful lighting. Notably, in the case of a high beam, the lighting provided by this must be at a high level which is either specified by regulations or determined by motor vehicle manufacturers.

In the configuration where the high beam is at least partially formed by a pixelated beam, the required lighting value must be obtained, at least in a central segment of the beam. This central segments takes the form, notably, of a light strip composed of at least one lighting unit. In other words, the light module generating the pixelated beam must produce at least one lighting unit forming the central segment, called the central lighting unit, which provides the desired lighting. In this case, the central lighting unit is a high-intensity lighting unit.

For this purpose, the light module comprises a plurality of light guides arranged in a horizontal array. Each of these guides extends between an input diopter and an output. One of these guides is placed in the middle of the horizontal array and is called the central guide.

The central guide contributes to the generation of the central lighting unit. Usually, a high-power light source is placed before the input diopter of the central guide so that the central lighting unit has the desired illumination. By way of example, the high-power light source may be a multi-chip light-emitting diode, notably one of the triple-chip type.

However, such a light source is expensive, and this affects the overall manufacturing cost of the lighting device comprising the light module and the high-power light source.

Consequently there is a need to reduce the manufacturing cost of light modules generating light beams requiring a strongly illuminated area, while conforming to the requested illumination value.

For this purpose, a first object of the invention is a vehicle light module comprising:

- a component comprising a plurality of light guides, each of said guides extending between an input diopter of this guide and an output, the adjacent light guides being joined to each other by a material junction;

- a plurality of light sources arranged facing the input diopters of some or all of the light guides;
- a projection system downstream of the guide outputs, having a focal surface projecting an image of every light ray passing through said focal surface.

According to the invention, the light module comprises at least two guides in which the distance between the focal surface and the junction of said two guides is greater than the distance between the focal surface and the junction of the other guides.

In other words, among all the light guides, there are at least two light guides that are joined together upstream of the other guides and also upstream of the focal surface. These two light guides form an assembly called a special assembly.

The output of each of the guides of said special assembly is therefore arranged at the junction between them, the two guides being joined there into a single guide forming the terminal portion of said special assembly. The downstream end of this terminal portion forms the output of said special assembly.

The advantage of a special assembly consisting of two light guides whose junction is upstream of the junction of the other guides is explained below. Evidently, the same advantage is found with other special assemblies comprising more than two light guides which are joined upstream of the other guides.

The special assembly of two light guides comprises two input diopters and a single output. Two distinct light sources can therefore be placed before the two respective input diopters of this assembly.

The light rays from these two distinct light sources are mixed inside the special assembly, more precisely in the terminal portion of said assembly, upstream of the single output of said special assembly. Thus, a resultant luminous flux is obtained at the output of the special assembly, this flux being the sum of the luminous flux at the outputs of all the guides of the assembly.

These two light sources may therefore be carefully chosen so that, when the luminous flux at the outputs of all the guides of the assembly is added up, we obtain the resultant luminous flux at the output of the special assembly, which is equal to the luminous flux at the output of the prior art light guide. It should be noted that said prior art light guide is the one that contributes to the generation of a high-intensity lighting unit.

Specifically, the two light sources may be low-energy light sources that have less lighting power than the more powerful single light source according to the prior art. Notably, according to the invention, the light sources interacting with said special assembly may be single-chip light-emitting diodes, whereas, in the prior art, the light-emitting diodes used for the maximum level of a light beam, notably a high beam, are usually triple-chip light-emitting diodes.

Such light sources are usually less expensive than the single high-power light source according to the prior art, making it possible to reduce the manufacturing cost of the light module according to the invention. Notably, two of these sources are less expensive than one single light source used in the prior art.

In other words, because of the particular configuration of the light module according to the invention, the less expensive components, in this case less powerful light sources, may be used while maintaining the same efficiency of the generated beam.

Thus, as a result of the light module according to the invention, the technical problem relating to the prior art is overcome.

The light module according to the invention may optionally have one or more of the following characteristics:

- the light guides are positioned in a horizontal array; and the two guides, in which the distance between their junction and the focal surface is greater than the distance between the focal surface and the junction of the other guides, are placed in the center of said horizontal array, and are called central guides; a light module arranged in this way may be used to generate at least a portion of the high beam, including the required highly illuminated area;
- the light module is intended to generate a light beam along an optical axis, and the central guides are equal in number on either side of said optical axis; the light module arranged in this way can generate at least one central lighting unit, symmetrical about the optical axis of the module;
- according to the last two clauses, the central guides are two in number; in one configuration of the light module, two central guides are sufficient to create a central lighting unit having the desired illumination; moreover, two central guides are easily provided;
- according to any of the preceding clauses, a single-chip light-emitting diode is placed before the input diopter of each central guide; the single-chip light-emitting diode is less expensive than a multi-chip light-emitting diode; this is therefore an economical alternative to the high-power light source;
- the single-chip light-emitting diodes are arranged on a printed circuit according to a surface-mount technology; the light-emitting diodes formed according to this technology are soldered onto the printed circuit; the latter may be connected to a heat sink for dissipating the heat given off by this circuit; light-emitting diodes soldered onto the printed circuit are usually less expensive than when they are bonded directly onto the heat sink;
- the angular spacing between the two central guides is an angle of between 5° and 15°;
- the distance between the focal surface and the junction of the central guides, called the first distance d1, is more than 0.5 mm; by way of example, the first distance $d_1$ may be between 1.5 mm and 15 mm;
- the distance between the focal surface and the junction of the guides other than the central guides, called the second distance $d_2$, is between 1 mm and 4 mm;
- the light module comprises, for example, eight light guides;
- the light module is capable of generating a pixelated light beam;
- the at least two guides in which the distance between the focal surface and the junction of said two guides is greater than the distance between the focal surface and the junction of the other guides are called secondary guides, the other guides being called primary guides, each primary guide forming a primary lighting unit in the beam and the secondary guides jointly forming a single secondary lighting unit in the beam, the lighting units being arranged adjacently in at least one array and being selectively activatable;
- the lighting units are light strips;
- the secondary lighting unit is central; for example, in the case of the preceding clause, the secondary lighting unit forms a central light strip;
- the secondary lighting unit has an intensity greater than the intensity of each primary lighting unit;
- the light module is arranged so as to generate a light beam forming a portion of a high beam;
- the projection system comprises a primary lens receiving the rays leaving the outputs of the light guides and projecting them toward infinity;
- according to the preceding clause, the component comprising the light guides and the primary lens are made of the same material, in a single piece; this makes it possible to reduce the number of separate components of the light module and simplify the assembly of said module.

The invention also relates to a lighting device comprising a first light module arranged so as to generate a primary portion of high beam. Said device further comprises a light module according to the invention, called the second light module, arranged so as to generate a secondary portion of high beam, complementary to the primary portion generated by the first module.

In this document, unless specified otherwise, the terms "upstream" and "downstream" refer to the direction of propagation of the light in the object to which they refer, and also to the direction of light emission outside said object.

Additionally, everything called "front" is located on the upstream side, while everything called "rear" is located on the downstream side.

The terms "horizontal", "vertical", "transverse", "lower", "upper", "high", "low", and "side" are defined with respect to the orientation of the light module or a component forming part of the light module according to the invention in which it is to be fitted in the vehicle. In particular, in this application, the term "vertical" denotes an orientation perpendicular to the horizon, while the term "horizontal" denotes an orientation parallel to the horizon.

In the remainder of the description, the vertical direction is represented by the axis V shown in FIGS. 1 to 4. "Horizontal" denotes all orientations that belong to, or that are parallel to, a plane passing through the axis L and the axis T shown in FIGS. 1 to 4.

Other characteristics and advantages of the invention will be apparent from a perusal of the following detailed description of non-limiting examples, for the comprehension of which reference should be made to the attached drawings, in which.

Figure 1:
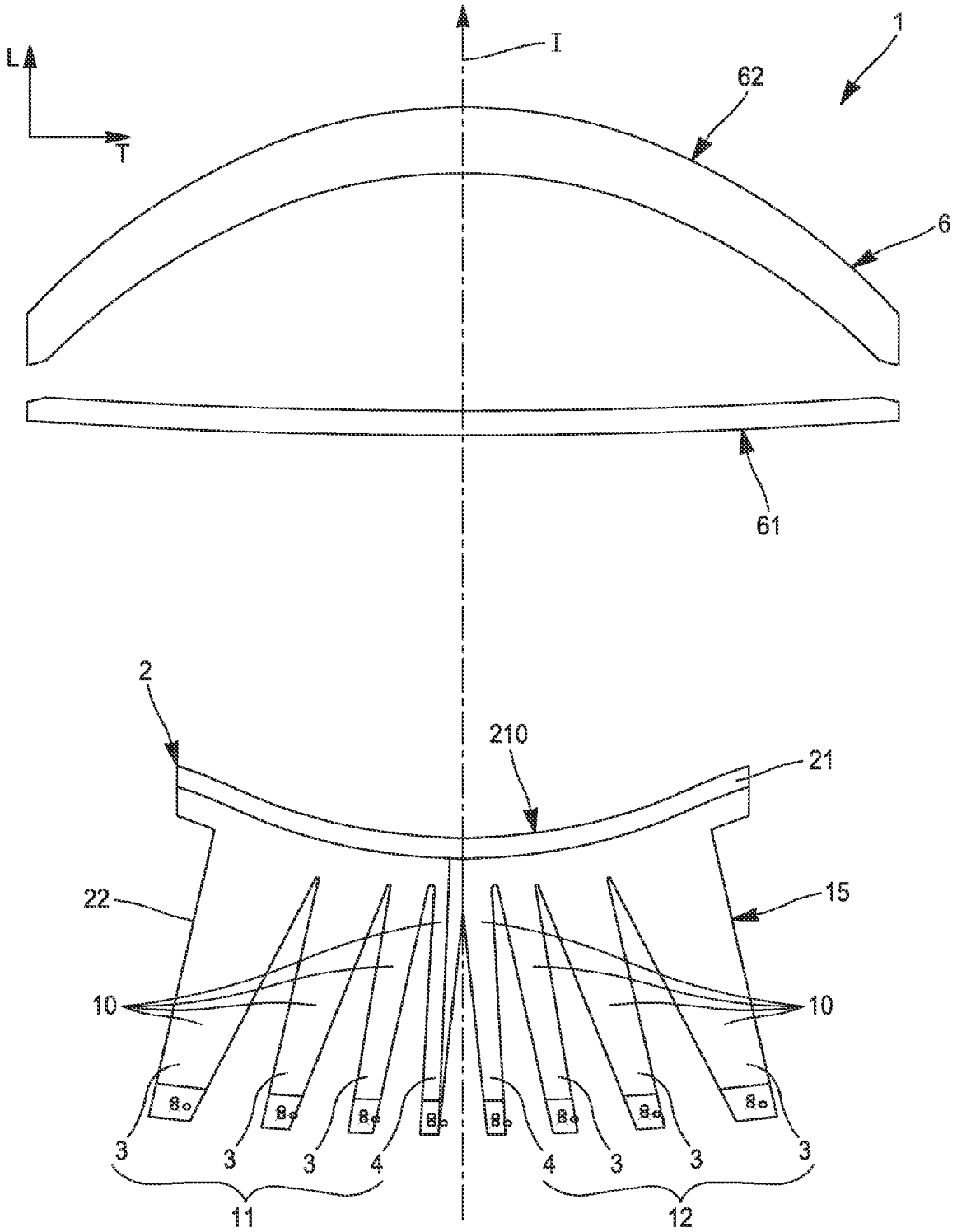
FIG. 1 is view from above of an example of embodiment of a light module according to the invention.
Figure 2:
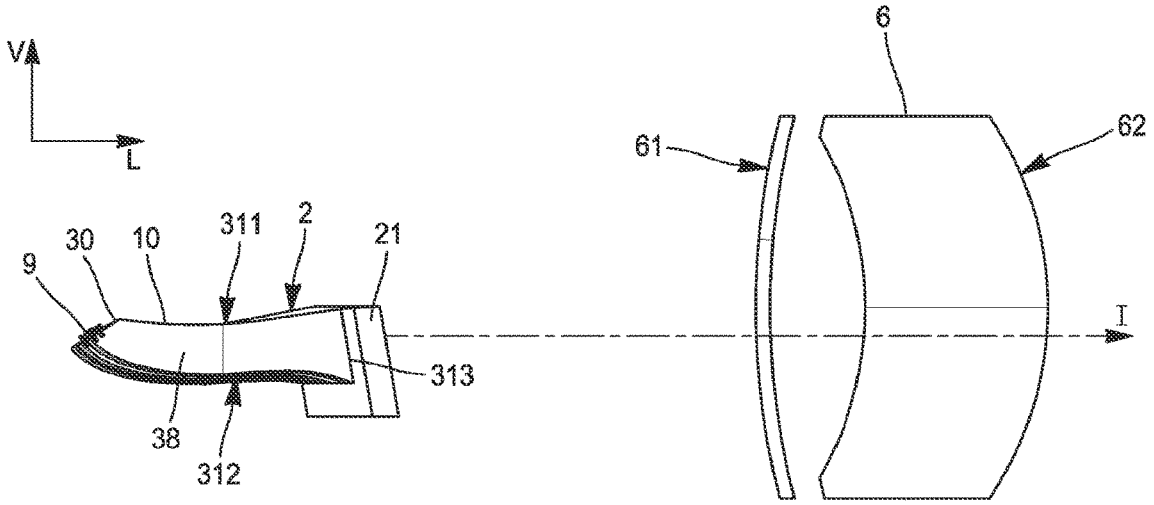
FIG. 2 shows a side view of the light module according to FIG. 1.

With reference to FIG. 1 and FIG. 2, a light module 1 according to an example of embodiment of the invention is intended to generate a light beam in the direction of an optical axis I. The light module 1 comprises a component 2 carrying a plurality of light guides 10 and a primary lens 6. The latter is placed at a distance from, and downstream of, the component 2, so as to receive the light rays leaving said component 2.

The component 2 carrying all the light guides is called a guide component 2 below. This guide component 2 comprises a first portion 21 from which the light guides 10 extend longitudinally in the upstream direction. The first portion 21 comprises a first face 210 positioned facing the primary lens 6 and gently curved away from said primary lens 6. In other words, the first portion 21 of the component 2 is concave.

In this case, the light guides 10 form a second portion 22 of the component 2. Said guides 10 are aligned so as to form a horizontal array 15 of guides. Additionally, these light guides 10 are arranged in a fan shape. This is because the light guides 10, in this case, extend in a direction that is slightly inclined with respect to the longitudinal direction L parallel to the optical axis I.

More precisely, in the illustrated example, the light guides 10 are eight in number and are arranged on either side of the optical axis I. The first half 11 of the light guides 10 is located on the left of the optical axis I with respect to the direction of emission of the light. Said first half 11 of the light guides are inclined toward the right. The second half 12 of the guides is located on the right of the optical axis I with respect to the direction of emission of the light. Said second half 12 of the light guides are inclined toward the left. In other words, the first half 11 and the second half 12 of the light guides are mirror-symmetric with respect to the optical axis I. The respective axes of the light guides 10 converge at an imaginary common point.

Unless specified otherwise, the terms "left" and "right" are defined with respect to the direction of propagation of the light within the light module 1 and outside said module 1. In this case, given the arrangement of the light module 1, the terms "left" and "right" correspond to the left and the right, respectively, of FIGS. 1, 3 and 4.

Additionally, in the illustrated example, each light guide 10 has a variable cross section in the direction of the length. In this case, the cross section of each light guide 10 increases from upstream to downstream.

Furthermore, the light guides 10 do not all have the same thickness. In this case, the thickness is taken to be the dimension measured in the lateral direction represented by the axis T in FIGS. 1 to 4. This is because the thickness of the light guides 10 varies as a function of the location of these guides in the array 15. In this case, the light guide becomes thicker as its distance from the optical axis I increases. This characteristic is clearly visible in FIG. 3. The light guides 31 and 38, located at the left end 151 and the right end 152, respectively, of the array 15, are the thickest guides of the array 15.

In the illustrated example, the adjacent light guides 10 are joined to each other by a material junction. According to the location of the junction, the light guides 10 are classed in two categories of guides, namely the primary guides 3 and the secondary guides 4. The difference between the primary guides 3 and the secondary guides 4 lies in the fact that the junction between the adjacent secondary guides 4 is located upstream of the junction between the primary guides 3. This difference will be explained in detail subsequently in the description.

According to the invention and in the illustrated example, the light module 1 comprises two secondary guides 4 located in the middle of the horizontal array 15 of guides. Thus these secondary guides 4 are henceforth called the central guides 4. These central guides 4 are positioned on either side of the optical axis I of the light module, and of these a first central guide 41 is located on the left of the optical axis I and a second central guide 42 is located on the right of the same axis I.

All the light guides 10, regardless of their category, comprise an input diopter 30, 410 or 420. Viewed from the side, all the light guides 10 have a curved profile such that the input diopters are oriented upward, as shown in FIG. 2.

Light sources 9 may be arranged facing the input diopters of some or all of the light guides 10.

The primary lens 6 is placed at a distance from, and downstream of, the component 2, so as to receive the light rays leaving the first face 210 of said component 2. In this case, the primary lens 6 comprises a downstream face 62 at the rear and an upstream face 61 in front. In FIG. 1 and FIG. 2, the upstream face 61 is less curved than the downstream face 62.

Figure 4:
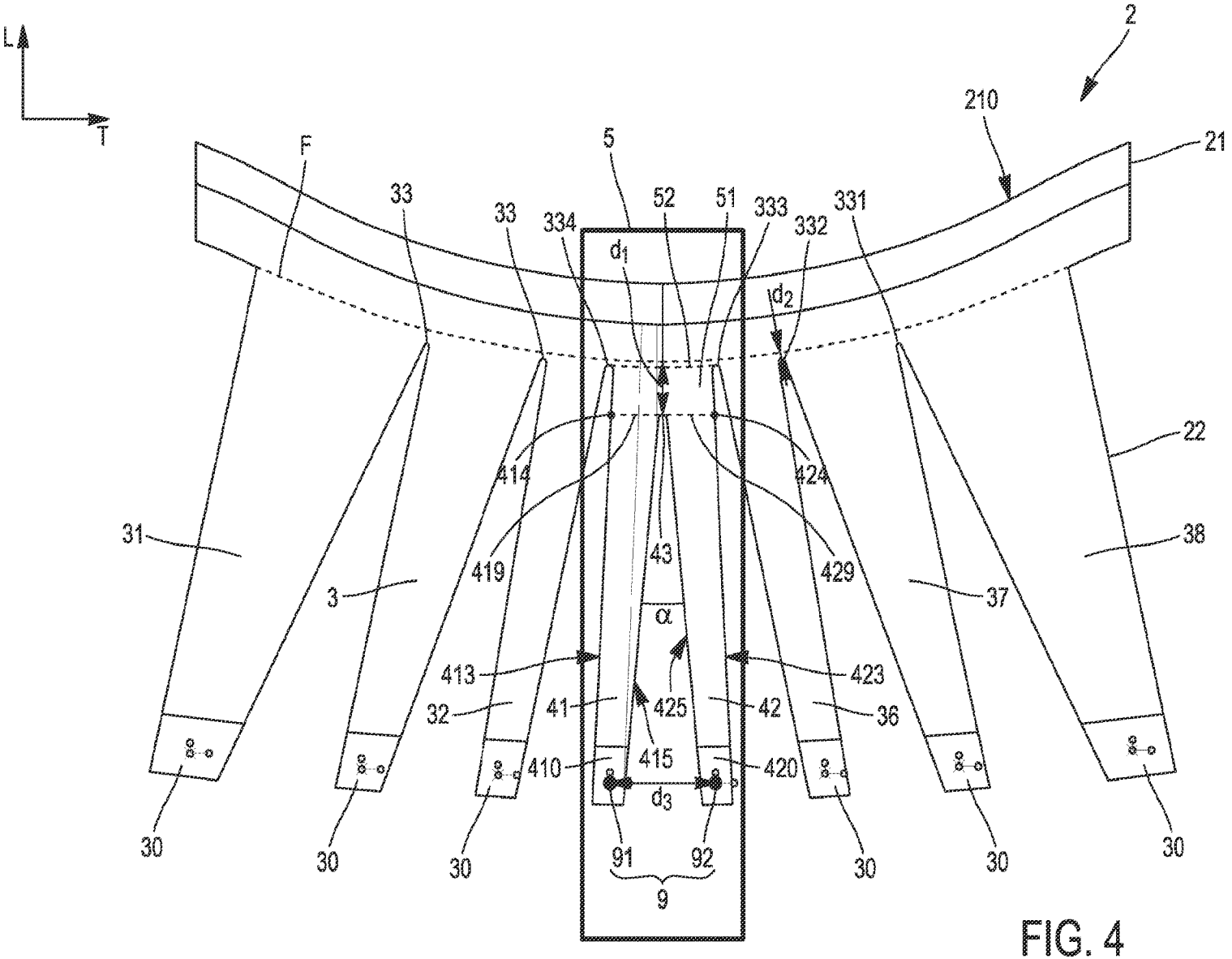
FIG. 4 is a view from above of the component of FIG. 3.

The primary lens 6 is arranged so as to form a focal surface F represented by the dotted line in FIG. 4. The primary lens 6 therefore forms a projection system of the outputs of the guides 10 of the component 2.

Figure 3:
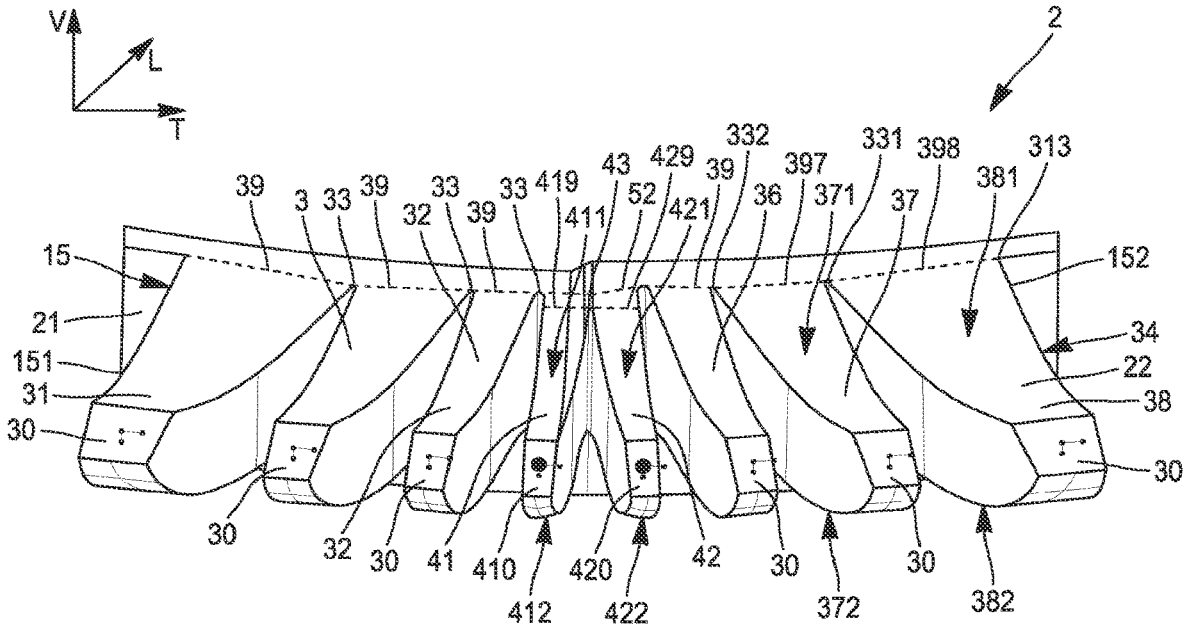
FIG. 3 shows a rear view of a component comprising a plurality of light guides; said component forms part of the light module of FIG. 1.

FIGS. 3 and 4 represent, respectively, a rear view and a top view of the second portion 22 of the component 2, to show more clearly the difference in level between the junction of the primary guides 3 and the junction of the central guides 4.

In the illustrated example, the light module 1 comprises six primary guides 3, including three guides counted from a left-hand end 151 of the horizontal array 15, and another three guides counted from a right-hand end 152 of the same array 15.

Each of the primary guides 3 comprises an input diopter 30 and an output 39. The outputs 39 of the primary guides 3 are shown in mixed lines in FIG. 3.

In this case, for the primary guides located at the ends of the array, for example the right-hand end primary guide 38, the output, bearing the reference 398, is a surface delimited vertically by an upper face 381 and by a lower face 382 of said primary guide 38. The output 398 is also delimited laterally by a vertical edge 313 of a right-hand lateral face 34 of the guide 38, and by a junction 331 with the adjacent primary guide, located on the left of said guide 38. The adjacent primary guide bears the reference 37 in FIG. 3.

The output of the left-hand end primary guide 31 is defined in a similar manner.

As regards the other primary guides 3, for example the primary guide 37 neighbouring the right-hand end guide 38, the output, bearing the reference 397, is a surface delimited vertically by an upper face 371 and by a lower face 372. Said output 397 is delimited laterally by a first junction 331 with the right-hand end primary guide 38 and by a second junction 332 with the primary guide located on the left of the primary guide 37. The primary guide located on the left of the primary guide 37 bears the reference 36 in FIG. 3.

Since the location of the junction 43 of the two central guides 4 is different from those of the junctions 33, 331, 332 of the primary guides 3, the outputs of the central guides 4 are defined in a slightly different way from that of the primary guides 3. The junctions 33, 331, 332 of the primary guides 3 are referred to below as the primary junctions 33, 331, 332.

The central guides 4, namely the first central guide 41 and the second central guide 42, are joined to each other at a junction 43, called the central junction 43. The angular spacing between the first central guide 41 and the second central guide 42 may be a value between 5° and 15°. In this case, the angular spacing is defined by the angle $\alpha$ formed by the right-hand lateral face 415 of the first central guide 41 and the left-hand lateral face 425 of the second central guide 42.

As shown in FIGS. 3 and 4, the central junction 43 is located upstream of the primary junctions 33, 331 and 332.

Therefore, the outputs of the central guides 4 are also located upstream of the outputs 33 of the primary guides 3.

More precisely, as shown in FIGS. 3 and 4, the first central guide 41 comprises an input diopter 410 and an output 419 indicated by small dashes in these FIGS. 3 and 4. The output 419 of the first central guide 41 is referred to hereafter as the first output 419.

The first output 419 is a surface delimited vertically by an upper face 411 and by a lower face 412 of the first central guide 41. The first output 419 is also delimited laterally by the central junction 43 and, in this case, by a substantially vertical line 414 belonging to a left-hand lateral face 413 of the first central guide 41. This vertical line 414 is located at the level of the central junction 43.

As regards the second central guide 42, this comprises an input diopter 420 and an output 429, also indicated by a line of small dashes in FIGS. 3 and 4. The output 429 of the first central guide 41 is referred to hereafter as the second output 429.

In a similar way to the first central guide 41, the second output 429 is a surface delimited vertically by an upper face 421 and by a lower face 422 of said second central guide 42. The second output 429 is also delimited laterally by the central junction 43 and by a substantially vertical line 424 belonging to a right-hand lateral face 423 of the second central guide 42. This vertical line 424 is located at the level of the central junction 43.

The first and second central guides 41 and 42, arranged in this way, form an assembly of two central guides, called a special assembly 5.

Beyond the first output 419 and the second output 429, the first central guide 41 and the second central guide 42 are united into a single guide, forming a terminal portion 51 of the special assembly 5.

The downstream end of the terminal portion 51 forms the output 52 of the special assembly 5. In other words, the terminal portion 51 is delimited longitudinally by the first and second outputs 419, 429 on the one hand, and by the output 52 of the special assembly 5 on the other hand.

In this case, the output 52 of the special assembly 5 is delimited laterally by a third junction 333 between the second central guide 42 and the primary guide 36 located on the right of said second guide 42, and by a fourth junction 334 between the first central guide 41 and the primary guide located on the left of said first guide 41, bearing the reference 32 in FIGS. 3 and 4.

In other words, the output 52 of the special assembly 5 is arranged at the level of the junction 334 between the first central guide 41 and the neighboring primary guide 32 on the left, and at the level of the junction 333 between the second central guide 42 and the neighboring primary guide 36 on the right.

Thus the output 52 of the special assembly 5 is separate from the first output 419 and the second outlet 429, and is located downstream of said outputs 419 and 429.

As shown in FIG. 4, the focal surface F of the primary lens 6 is arranged so as to be as near as possible to the outputs 39 of the primary guides 3 and to the output 52 of the special assembly 5. Thus the light rays leaving the primary guides 3 and the special assembly 5 are imaged by the primary lens 6, while optical field aberrations are minimized.

Additionally, the focal surface F has a degree of curvature substantially resembling that of the first face 210 of the component 2.

The central junction 43 is more distant from the focal surface F than the primary junctions 33, 331, 332 are from said focal surface F. In other words, the distance $d_1$ between the focal surface F and the central junction 43 is greater than the distance $d_2$ between the focal surface F and the primary junctions, notably the second primary junction 332.

Two light sources 9 are arranged facing the input diopters of the central guides 4. In this case, a first light source 91 is placed facing the input diopter 410 of the first central guide 41, while a second light source 92 is placed facing the input diopter 420 of the second central guide 42.

By way of example, the first light source 91 laterally distant from the second light source 92 by an amount of between 3 mm and 7 mm. In FIG. 4, the lateral distance between the first light source 91 and the second light source 92 is represented by the reference "$d_3$".

By way of example, the first and second light sources 91 and 92 may be single-chip light-emitting diodes.

The first light source 91 emits light rays that are propagated in the first central guide 41 up to the first output 419. Similarly, the second light source 92 emits light rays that are propagated in the second central guide 42 up to the second output 429.

Beyond the first and second outputs 419 and 429, the light rays reach the terminal portion 51 where said rays can mix with each other. In the terminal portion 51, walls delimiting this portion reflect the light rays so as to form a uniform collimated light beam at the output 52. Thus this uniform collimated beam reaches the focal surface F and is projected by the primary lens 6, forming an image comprising a high-intensity lighting unit.

Figure 5:
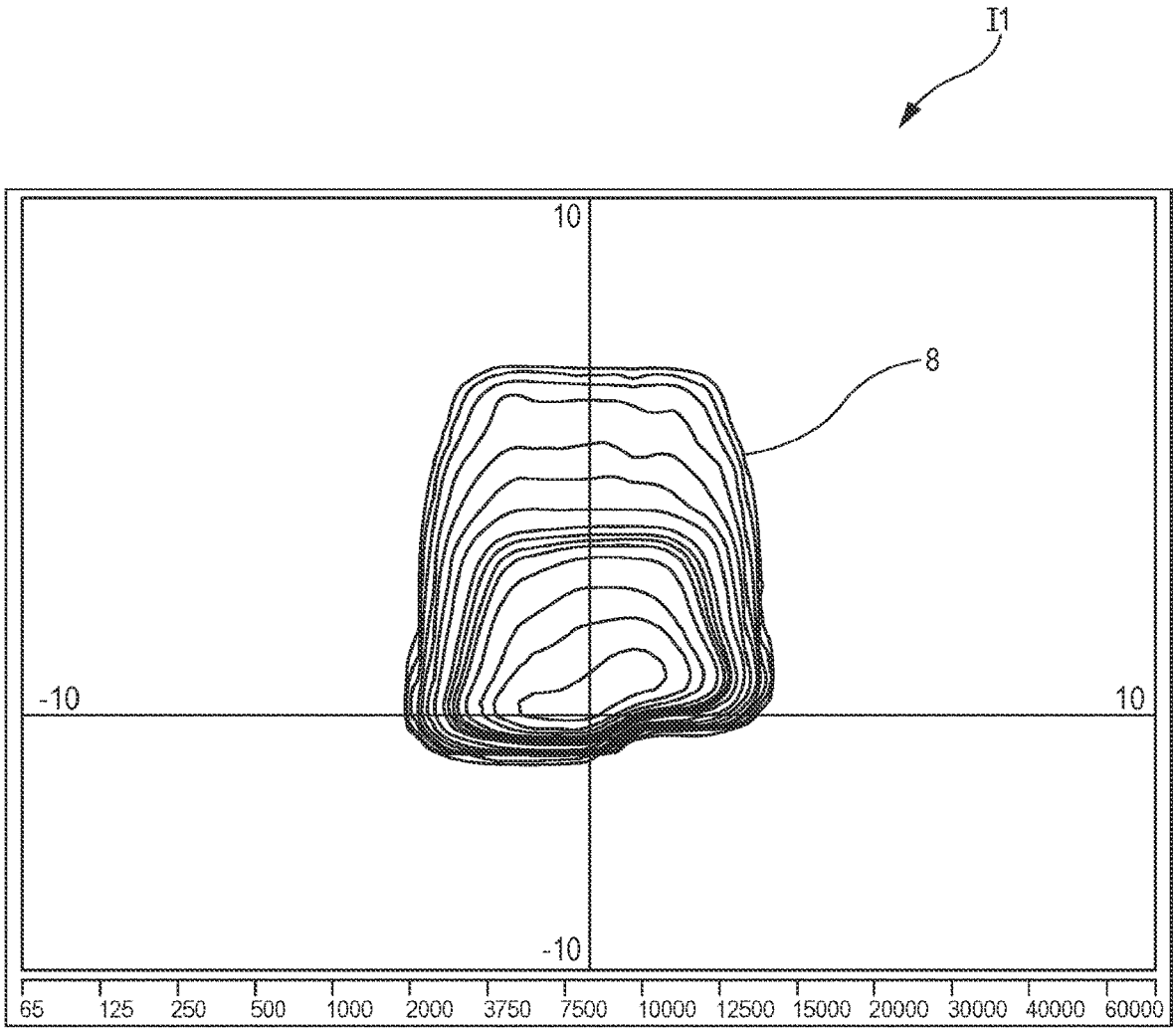
FIG. 5 shows the image generated by the light module of FIG. 1; said image takes the form of isolux curves, projected on a vertical screen, notably at a distance of 25 meters in front of the light module of FIG. 1.

FIG. 5 shows, by way of example and in a schematic way, an image I1 of the light beam generated from the two light sources 91 and 92 and from the light module 1. The image I1 is obtained, for example, on a screen located 25 m from the light module 1.

In this case, the image I1 comprises a lighting unit 8 of rectangular shape, and has a high light intensity. By way of example, in a configuration where the first and second light sources 91 and 92 are light-emitting diodes, each having a luminous flux of 250 lm, the lighting unit 8 may have a maximum illumination of 110 lux.

Furthermore, the resulting lighting unit 8 has a fairly regular rectangular shape. Thus, said lighting unit 8, when placed with other lighting units (not shown) corresponding to the primary guides 3, contributes to the formation of a uniform pixelated light beam. The quality of this beam is therefore improved, enabling the driver's visibility comfort to be improved.

Evidently, other light sources may be placed before the primary guides in addition to the first and second light sources 91 and 92. In this case, the image obtained by the light module 1 will be different from the illustrated image I1. By way of example, the resulting image will comprise a light strip with a high-intensity lighting unit in the middle.

The light module 1 may be installed in a lighting device on the front of a motor vehicle. This lighting device may be designed to project a high beam. In this configuration, the lighting device comprises a first light module arranged so as to generate a primary portion of high beam. At the same time, the light module 1 described above, called the second light module, is arranged so as to generate a secondary portion of high beam. Said secondary portion is complementary to the primary portion of high beam and may be located above the low beam cut-off line.

The invention claimed is:

1. A motor vehicle light module comprising:

multiple light guides that are disposed in a same row; each of the multiple light guides having sidewalk extending between an input diopter and an output of the respective light guide, adjacent light guides being joined to each other by a material junction point at which the sidewalls of the two adjacent light guides intersect:

a plurality of light sources arranged facing the input diopters of some or all of the light guides; and a projection system downstream of the guide outputs, and having a focal surface (F) projecting an image of every light ray passing through the focal surface (F);

wherein a first distance ($d_1$) between the focal surface (F) and a first material junction point of two adjacent light guides is greater than a second distance ($d_2$) between the focal surface (F) and a second material junction point of other two adjacent light guides of the multiple light guides.

2. The light module as claimed in claim 1, wherein the multiple light guides are arranged in a horizontal array, and the two adjacent light guides which are jointed with the first material junction point are placed in the middle of the horizontal array, and are called central guides.

3. The light module as claimed in claim 2, wherein the central guides are equal in number on either side of an optical axis (I) along which a light beam is generated.

4. The light module as claimed in claim 2, wherein the central guides are two in number.

5. The light module as claimed in claim 2, wherein a single-chip light-emitting diode is placed in front of the input diopter of each central guide.

6. The light module as claimed in claim 5, wherein the light-emitting diodes are arranged on a printed circuit according to a surface-mount technology.

7. The light module as claimed in claim 2, wherein an angular spacing between the two central guides is an angle of between 5° and 15°.

8. The light module as claimed in claim 1, wherein the first distance (d1) is more than 0.5 mm.

9. The light module as claimed in claim 1, wherein the second distance ($d_2$) is between 1 mm and 4 mm.

10. The light module as claimed in claim 1, wherein the multiple light guides comprises eight light guides.

11. The light module as claimed in claim 3, wherein the light beam is a pixelated light beam.

12. The light module as claimed in claim 11, wherein the two central guides are called secondary guides, and the other light guides are called primary guides, each primary guide forming in the pixelated light beam a primary lighting unit in the pixelated light beam and the secondary guides jointly forming a single secondary lighting unit in the pixelated light beam, the lighting units being arranged adjacently in at least one array and being selectively activatable.

13. The light module as claimed in claim 12, wherein the lighting units are light strips.

14. The light module as claimed in claim 12, wherein the secondary lighting unit is arranged in the central of the at least one array.

15. The light module as claimed in claim 12, wherein the secondary lighting unit has an intensity greater than an intensity of each primary lighting unit.

16. The light module as claimed in claim 1, wherein the light module is arranged so as to generate a light beam forming a portion of a high beam.

17. A lighting device, comprising a light module which comprises a first light module arranged so as to generate a primary portion of a high beam, and in that it comprises the light module according to claim 16, called a second light module, arranged so as to generate a secondary portion of beam complementary to the primary portion generated by the first light module.

18. The light module as claimed in claim 3, wherein the central guides are two in number.

19. The light module as claimed in claim 3, wherein a single-chip light-emitting diode is placed in front of the input diopter of each central guide.

20. The light module as claimed in claim 3, wherein an angular spacing between the two central guides is an angle of between 5° and 15°.

* * * * *